US005387966A

United States Patent [19]

Karashima

[11] Patent Number: 5,387,966

[45] Date of Patent: Feb. 7, 1995

[54] DEVELOPING APPARATUS AND METHOD INCLUDING GROOVED DEVELOPER CARRYING ROLLER

[75] Inventor: Kenji Karashima, Kanagawa, Japan

[73] Assignee: Ricoh Company, Ltd., Tokyo, Japan

[21] Appl. No.: 65,758

[22] Filed: May 24, 1993

[30] Foreign Application Priority Data

May 22, 1992 [JP] Japan ..... 4-156026

[51] Int. Cl.[6] ..... G03G 15/08; G03G 15/09

[52] U.S. Cl. ..... 355/259; 118/653; 430/120

[58] Field of Search ..... 355/259, 251; 118/653, 118/657, 658; 430/120, 122

[56] References Cited

U.S. PATENT DOCUMENTS

| | | | |
|---|---|---|---|
| 3,667,428 | 6/1972 | Smith | 355/259 X |
| 3,945,723 | 3/1976 | Cook et al. | 355/259 X |
| 4,528,937 | 7/1985 | Kanno et al. . | |
| 4,538,898 | 9/1985 | Kanno et al. . | |
| 4,564,285 | 1/1986 | Yasuda et al. | 355/259 X |
| 4,575,220 | 3/1986 | Sakamoto et al. . | |
| 4,624,545 | 11/1986 | Yasuda et al. . | |
| 4,625,676 | 12/1986 | Sakamoto et al. . | |
| 4,656,964 | 4/1987 | Kanno et al. . | |
| 4,674,439 | 6/1987 | Sakamoto et al. . | |
| 4,788,570 | 11/1988 | Ogata et al. . | |
| 4,873,940 | 10/1989 | Ishikawa et al. . | |
| 4,971,302 | 11/1990 | Morii et al. . | |
| 5,072,920 | 12/1991 | Kubota et al. . | |
| 5,080,342 | 1/1992 | Mori et al. . | |
| 5,099,292 | 3/1992 | Hirose . | |
| 5,121,911 | 6/1992 | Yamazaki et al. . | |

FOREIGN PATENT DOCUMENTS

| | | | |
|---|---|---|---|
| 4-316067 | 11/1992 | Japan | 355/259 |

*Primary Examiner*—Joan H. Pendegrass

*Attorney, Agent, or Firm*—Oblon, Spivak, McClelland, Maier, & Neustadt

[57] ABSTRACT

A developing apparatus having an improved construction for a developer carrying roller, particularly the developing roller which applies developer to a photosensitive body which carries a latent image. The developing roller or developer carrying roller includes a dielectric surface having a groove or grooved surface thereon formed, for example, by engraving, with the groove preferably extending along a central portion of the roller corresponding to the width of the latent image forming area of the photosensitive body. Preferably, the groove imparts a surface roughness in the axial direction of the roller in the range of 5-30 μm, with the width of the groove not greater than 400 μm. The roller may be formed such that adjacent grooved portions are immediately adjacent one another, or a smoothed flat portion may be interposed between adjacent grooved portions.

20 Claims, 3 Drawing Sheets

DEVELOPING APPARATUS AND METHOD INCLUDING GROOVED DEVELOPER CARRYING ROLLER

BACKGROUND OF THE INVENTION

1. Field of the Invention

The invention relates to a developing apparatus which is typically utilized in an image forming device such as a copying machine, facsimile machine, printer, etc. In particular, the present invention provides an improved developing apparatus and method, particularly with regard to the supply or carrying of developer by a developing roller which supplies developer to a latent image carrying body such as a photosensitive element. Significantly, an improved developer carrying roller is provided which supplies one-component developer to the photosensitive element.

2. Discussion of Background

Recently, a large number of developing devices have been designed and used which employ one-component developer in order to simplify the developing device and reduce the cost thereof. One-component developer does not contain a carrier (which functions as a developing electrode in the developing area and facilitates carrying of toner). For carrying one-component developer, a dielectric layer is formed on the surface of the developer carrying body, such as a developer carrying roller. In order to improve image quality, the surface of the roller can be roughened utilizing a sandblasting or sandpapering technique, thus improving the carrying force for the developer. Alternatively, the developer carrying body's surface can be provided with a concave/convex surface to allow the surface to function as an electrode.

Japanese Laid-Open Patent Publication No. 55-153973/1983 provides an example of a developer carrying body which is formed of a smooth concave/convex surface, with the objective to enable stable formation of images over a long period of use. Japanese Laid-Open Patent Publication No. 55-113070/1980 describes the surface of a developer carrying body of a contact developing type which is formed of a resilient material having a surface roughness which is not smaller than 6 μm. Further, Japanese Laid-Open Patent Publication No. 59-126567/1984 teaches the roughness of the developer carrying body can be formed in the range 2–10 μm utilizing sandblasting or sandpaper. Further, Japanese Laid-Open Patent Publication No. 59-189374/1984 teaches that a non-contact type developing device for use with nonmagnetic toner can be provided with a surface having peaks or protrusions which are 2.75–3.0 times the average particle diameter of the developer to be used. Further, the distance between the adjacent peaks should be made larger than the height of each peak, and smaller than the development gap (i.e., the distance between the surface of the photosensitive body and the developer carrying body).

A further example of the various types of developer carrying bodies or rollers is provided in Japanese Laid-Open Publication No. 3-4461/1991 in which the developing apparatus includes a sleeve-shaped developer carrying body having a surface roughness of 2–3 times the average particle diameter of the developer, with a scraper provided for scraping off any remaining toner adhering to the developer carrying body. Japanese Laid-Open Publication Nos. 3-1419/1991 and 3-14192/1991 respectively describe an alumite treatment is provided upon the surface of the one-component developer carrying body, and thereafter the smoothness of the developer carrying body's surface is roughened by sandblasting using fixed form or non-fixed form particles. However, when utilizing a developer carrying body having a dielectric surface layer and a contact type developing method, it has been recognized that projecting portions of several μm cause a concentration of the electric field on the surface of the dielectric body, which results in an abnormal image. Often such an image will have a blank area. To avoid this problem it has been necessary to suppress the roughness of the dielectric area to less than 5 μm.

However, when the surface of the dielectric layer is smooth, additional problems results in that charging of the developer can be insufficient (for example, as in the arrangement of Japanese Laid-Open Publication No. 59-126567/1984), and the developer carrying ability is weakened. In addition an overdeveloping phenomenon (fogging) on background areas of an image often occurs. Further, problems can be encountered with the formation of lines which are parallel to the direction of movement of the latent image carrying body, with such lines developed thinly, and in some instances the developed line will be broken-off or include a discontinuity (this problem is referred hereinafter as thin longitudinal line development or longitudinal line thinning).

Accordingly, an improved developing apparatus and method is desired which can avoid the foregoing problems. In particular, a developing unit and process for one-component developer is desired which avoids problems associated with fogging and thin line longitudinal development. Such an arrangement, or process should also avoid problems associated with previous roughening approaches, e.g., abnormal or blank areas resulting from concentrations in the electric field. In addition, such a developing apparatus should have a relatively simple construction, thereby avoiding increased costs of manufacture.

SUMMARY OF THE INVENTION

Accordingly, it is an object of the present invention to provide an improved developing apparatus and method which avoids overdeveloping, particularly in background areas.

It is a further object of the present invention to provide a developing apparatus which avoids thin longitudinal line development problems.

It is a still further object of the present invention to provide an improved developing method and developer carrying roller which reliably supplies developer to a photosensitive body, with the developer carrying roller having a relatively simple structure which can be readily manufactured.

It is another object of the present invention to provide a developing method and apparatus which avoids problems associated with the use of a smooth developer carrying roller, while also avoiding problems associated with other roller roughening techniques.

These and other objects and advantages are achieved in accordance with the present invention which includes a developing device which is suitable for carrying one-component developer into contact with a latent image carrying body or photosensitive body. In one embodiment of the present invention, the developer carrying body, such as a developer carrying roller, includes a spiral groove formed on the dielectric surface thereof, with the groove imparting roughness to the roller, and with the roughness of the surface in the range of 5 μm to 30 μm in the axial direction of the roller. The spiral groove extending along the roller surface thus provides a plurality of adjacent grooves or groove portions which roughen the roller while avoiding problems associated with conventional roughening techniques (e.g. sandblasting). In accordance with a further aspect of the present invention, it has been recognized that the width of each of the adjacent grooves or groove portions should be not larger than 400 μm along the axis of the roller. In addition, it has been recognized that a further advantage is achieved by utilizing one-component developer particles having an average diameter of not larger than 10 μm. Further, a smoothed or flat portion can be interposed between adjacent grooves or groove portions in the axial direction of the roller, with a preferred width of the smoothed or flat portions not larger than 150 μm. In accordance with yet another preferred feature, the groove is formed on the developer carrying roller only in the area corresponding to the width of the latent image forming area of the latent image carrying body or photosensitive element such as a spiral groove.

Thus, in accordance with the present invention, it has been recognized that by providing a groove such as a spiral groove in the dielectric surface of a developer carrying roller to form a surface roughness of 5–30 μm the performance of the developing apparatus is improved, while disadvantages associated with other roughening approaches are avoided.

BRIEF DESCRIPTION OF THE DRAWINGS

These and other objects and advantages of the present invention will become readily apparent from the following detailed description, particularly when considered in conjunction with the drawings in which.

DETAILED DESCRIPTION OF THE PREFERRED EMBODIMENTS

Figure 4:
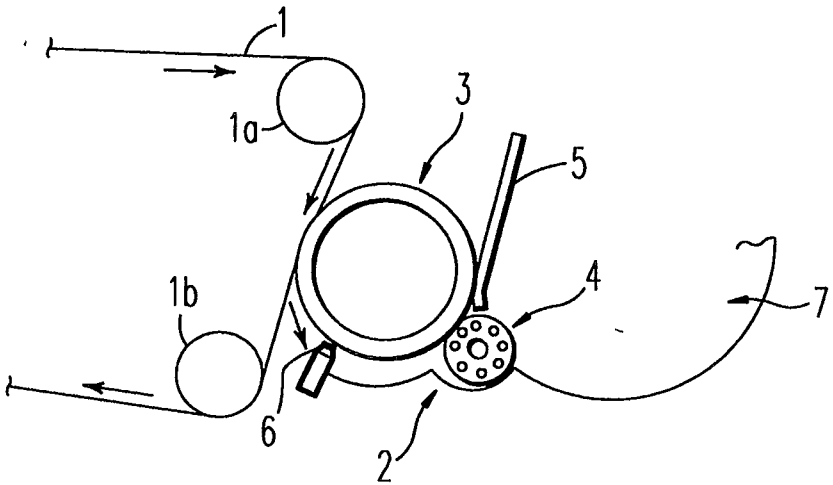
FIG. 4 is a side view of the general construction of a developing apparatus including an improved developer roller structure as in the present invention.

Referring briefly to FIG. 4, an overview of a developing arrangement will be described. Such a developing arrangement can be used, for example, in a copying machine. As shown in FIG. 4, a belt-type photosensitive body or optical photoconductor is provided which acts as a latent image carrier. The photosensitive body is mounted on a plurality of supporting rollers (1*a*, 1*b*) and driven to rotate in the direction indicated by the arrow. As is well-known, a charger is also provided for uniformly charging the photosensitive body, with an optical system provided for forming an electrostatic latent image, and a suitable arrangement for transferring the toner image onto the transfer sheet. A cleaning apparatus is also provided for removing toner after the toner has been transferred from the developing roller 3 to the photosensitive body 1. A charge removing assembly is also provided for removing charges from the photosensitive body, however the optical system, transfer arrangement and charge removing means are not shown in FIG. 4. The developing apparatus 2 of the present invention is disposed to face the photosensitive body 1 which is suspended upon supporting rollers 1*a*, 1*b*.

The developing apparatus 2 includes a developing roller 3 which carries developer, a supplemental roller 4 which supplies toner to the surface of the developing roller 3, with a thin layer forming blade 5 assisting in forming a thin layer of toner upon the surface of the developing roller 3. As the toner is applied to and/or rubbed against the developing roller 3 by the supplemental roller 4 and blade 5, the toner becomes frictionally charged and is then carried by the developing roller 3. In addition, a charge removing brush 6 is provided for removing electric charges from the surface of the developing roller 3. The toner container 7 contains, for example, magnetic one-component toner. The developing apparatus 2 is disposed such that the surface of the developing roller 3 is in contact with the photosensitive body 1 through the toner layer, thus providing a contact-type developing arrangement.

Figure 1A:
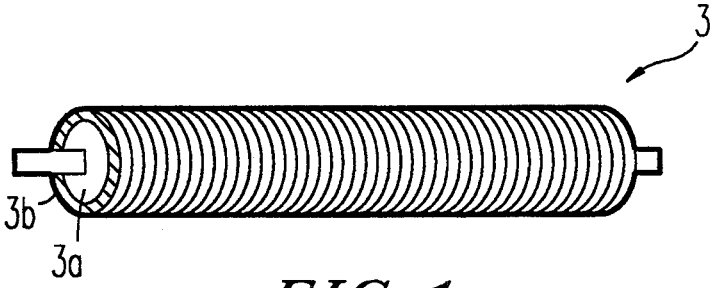
FIG. 1*a* is a perspective view of a developing roller in accordance with the present invention, with FIG. 1*b* showing an enlarged side view of a portion of the roller of FIG. 1*a;*

The developing roller includes a surface discussed in further detail hereinafter. As shown in FIG. 4, the developing roller 3 includes dielectric layer 3*b* which is formed on the surface of a substrate roller 3*a* formed, for example, of aluminum. In accordance with one aspect of the present invention, the surface of the dielectric layer 3*b* can be machined to provide a surface as shown in FIG. 1*a*.

A magnetic substance, such as a ferrite, is mixed with the dielectric layer 3*b*, which thus allows formation of a pattern of magnetic polls for attracting magnetic toner. Further, the developing roller 3 is driven in a counterclockwise direction as indicated in FIG. 4, with a developing bias applied to the developing roller by a conventional electric power supply not shown.

The supplemental roller 4 supplies toner from the toner container 7 onto the surface of the developing roller 3 by frictionally charging the toner. The roller 4 is also driven counterclockwise by a suitable drive, not shown. The roller 4 provides the additional function of removing toner which remains on the surface of the developing roller 3 which has not been transferred to the photosensitive body 1. It may also be possible to utilize a toner supplying rotatable bar which only provides the toner supply function.

The thin layer forming blade 5 is disposed such that the tip end portion is brought into contact with the surface of the developing roller 3. Blade 5 regulates the thickness of the toner sticking to the surface of the developing roller 3 to a preset amount. It is also possible to frictionally charge the toner on the developing roller 3 utilizing the thin layer forming blade 5. The charge removing brush 6 removes the electric charge from the surface of the developing roller 3 after it passes through the developing area. Other discharging devices such as a roller-shaped or blade-shaped charge removing device can also be used.

Figure 1B:
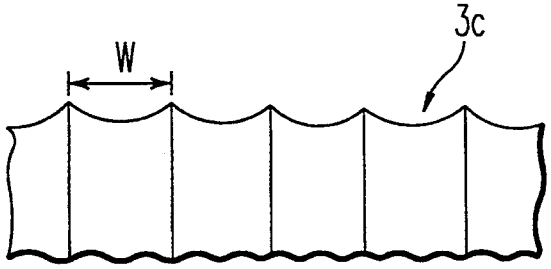
Figure 2:
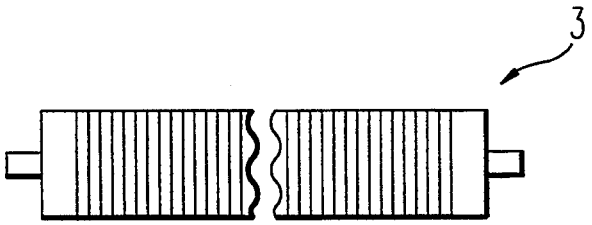
FIG. 2 is a side view of a modified form of the developing roller of FIG. 1*a;*

Referring now to FIGS. 1*a* and 1*b*, the roller 3 is preferably formed with a spiral groove 3*c* which is engraved on the surface of the dielectric layer 3*b*. In accordance with the present invention, it has been recognized that such a grooved pattern can be readily and reliably formed such that the surface of the roller 3 is imparted with a desired amount of roughness, while disadvantages associated with developing rollers roughened by other methods are avoided. Although it is possible to form the groove 3c over the entire width of the developing roller as shown in FIG. 1a, it may be preferable to provide the groove 3c only in the area corresponding to the width of the latent image forming area on the photosensitive body 1. For example, as shown in FIG. 2, with the groove formed only in the center of the roller, sealing members or scrapping members (not shown) can effectively prevent scattering of toner at the margins or ends of the roller.

In accordance with one advantageous aspect of the present invention, it has been recognized that the roughness of the surface formed by the groove 3c in the axial direction should be within the range of 5 μm to 30 μm. Further, it is desirable that the width W of the groove 3c in the axial direction of the roller is less than 400 μm in order to avoid the fogging phenomenon on the background, as well as to avoid longitudinal line thinning.

The dielectric layer 3b is formed of a dielectric substance having an inherent resistance of $10^{12}$–$10^{13}$ Ω cm, with the specific dielectric constant of 10–14, and with the diameter of the roller 16 mm.

As an illustration of the relationship of surface roughness to image quality, as well as to illustrate the achievement of the objectives of the grooved roller of the present invention particularly with regard to the aforementioned fogging and longitudinal line thinning, developing rollers were prepared having a groove width of approximately 100 μm in the axial direction of the roller 3, with rollers prepared having different surface roughnesses Rz in the range of 5–40 μm. The results are shown in Table 1 below. The O in the table represents the absence of the fogging or thinning phenomenon, with the Δ representing some appearance of fogging or thinning, but within acceptable limits. The X represents an unacceptable image quality.

TABLE I

| Rz (μm) | Fogging on the Background | Thinning of the Longitudinal Line |
|---|---|---|
| 5 | ○ | Δ |
| 10 | ○ | ○ |
| 15 | ○ | ○ |
| 20 | ○ | ○ |
| 30 | Δ | ○ |
| 40 | x | ○ |

As discussed earlier, the dielectric layer 3b is formed of a dielectric substance having an inherent volume resistance of $10^{12}$–$10^{13}$ Ω cm, with a dielectric constant of 10–14 and a diameter of 16 mm.

As a further comparison, rollers of the above construction were formed having varying groove widths, with a surface roughness of approximately 10 μm in the axial direction, with the performance of the developing apparatus also monitored with regard to the fogging and longitudinal line thinning phenomenon. The results are shown in Table 2, with the same symbols utilized as in Table 1. As indicated in the right column of Table 2, and as should be readily understood, the processing time in forming the roller is significantly greater for smaller groove widths, however if the groove width is excessively large, the performance of the developing apparatus deteriorates. This is demonstrated by the 500 μm width which yields tolerable results from a fogging standpoint, but unacceptable line thinning. Thus, in accordance with another aspect of the present invention, not only is the desired roughness imparted by a groove recognized, but also the desired width of the groove.

TABLE 2

| Width (AM) | Fogging on the Background | Thinning of the Longitudinal Line | Mechanical Processing Time |
|---|---|---|---|
| 50 | ○ | ○ | long |
| 100 | ○ | ○ | |
| 200 | ○ | ○ | ~ |
| 300 | ○ | ○ | |
| 400 | ○ | Δ | |
| 500 | Δ | x | short |

It is believed that the concave surface of the spiral groove formed on the developing roller improves the charging efficiency of the toner and the developer carrying ability of the roller 3 as compared with conventional developing rollers. As a result, the supplemental roller 4 and the thin layer forming blade 5 opposing the surface of the developing roller 3 can more effectively frictionally charge the toner. It is believed that a further reason for the improved performance resides in the prevention of toner from being drawn back onto the surface of the photosensitive body 1 (or vice versa), but rather, toner which is not used in developing a latent image is drawn onto the surface of the developing roller when the developing roller 3 is moving out of contact with the photosensitive body 1. More particularly, often as a developing roller is moving out of contact with a photosensitive body, toner will not be retained by the developing roller, or may fly off of the developing roller toward the photosensitive body which may cause fogging. Also, if the toner should fly from the photosensitive body back toward the developing roller, longitudinal line thinning or blank areas can occur. The structure of the developing roller 3 of the present invention provides an electric field and/or mechanical blocking action due to the concave surface of the spiral groove provided on the developing roller 3. Thus, more consistent and reliable charging characteristics are attained.

As a further optimization of the present invention, the developing apparatus of the present invention was examined with respect to differing types of toner. In particular, toner having different average diameter sizes were utilized with rollers of Tables 1 and 2 having acceptable results (i.e. with a roughness of approximately 10 μm and a groove width of approximately 100 μm), with the results shown in Table 3.

TABLE 3

| Average Volume Diameter of Toner (μm) | Result of Evaluating Image Quality | Remarks |
|---|---|---|
| 7.5 | ○ | |
| 10 | ○ | |
| 15 | x | Occurrences of scattering |

As demonstrated by the foregoing results, in accordance with another aspect of the present invention, it has been recognized that the performance of the developing apparatus is particularly improved by utilizing toner having an average volume diameter of not larger than 10 μm.

Figure 3A:
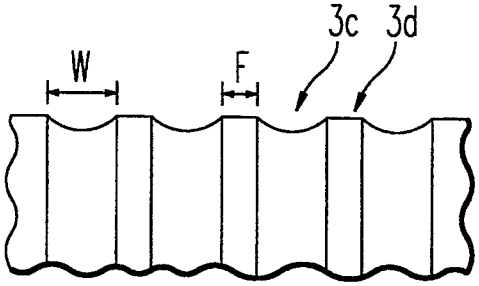
FIGS. 3*a*–3*c* are enlarged views depicting alternate embodiments and features of developing rollers in accordance with the present invention.

The foregoing embodiments provide a grooved arrangement with the grooves or grooved portions adjacent one another as shown in FIG. 1b. However, the developing roller 3 may also be formed with a smoothed or flat portion interposed between neighboring grooves as shown in FIG. 3*a*. In order to determine the extent for which a smoothed or flat portion 3*d* may be provided, a plurality of developing rollers were formed as in the previous embodiments, however with a flat portion 3*d* having differing widths F for the flat portion located between adjacent grooves. As in the previous examples, the developing rollers were formed to have a diameter of 16 mm, with the dielectric layer 3*b* having an inherent volume resistance of $10^{12}$–$10^{13}$ Ω cm, and with the specific dielectric constant of 10–14. The grooves were formed to provide a surface roughness of approximately 10 μm, with the widths of the flat F in the range of 50–200 μm, and with the groove width 80 μm. The performance of the developing rollers were evaluated with respect to fogging and longitudinal line thinning as shown in Table 4.

TABLE 4

| Width F (μm) | Fogging on the Background | Thinning of the Longitudinal Line |
|---|---|---|
| 50 | ○ | ○ |
| 80 | ○ | ○ |
| 150 | ○ | Δ |
| 200 | ○ | x |

As shown in Table 4, with rollers having flats in excess of 150 μm in width, longitudinal line thinning was observed to an unacceptable extent. By contrast, with flat widths F not greater than 150 μm, neither the fogging phenomenon nor the longitudinal line thinning phenomenon were intolerable. Thus, the toner can be fully frictionally charged in the portion of the surface of the developing roller 3 opposing the supplemental roller 4 and thin layer forming blade 5 with an arrangement which includes alternating grooved end flat portions, with preferable results obtained where the width of the flat portion is not greater than 150 μm.

As stated before, a significant effect of the structure provided in accordance with the present invention resides in the ability to maintain the toner properly drawn back onto the surface of the developing roller 3 after the portions of the developing roller have contacted the photosensitive body 1 and are moving away from the photosensitive body 1. It is believed that this caused by the electrical or mechanical blocking action caused by the concave surface formed by the groove, such as a spiral groove 3*c*, with the flat portion 3*d* also allowable on the roller 3 to the extent described while maintaining the desired performance.

Figure 3B:
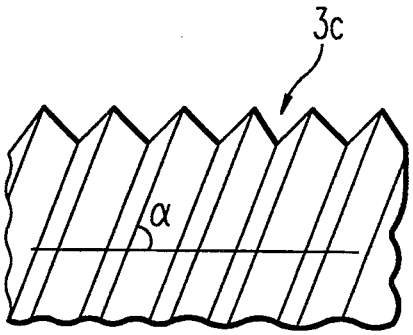
Figure 3C:
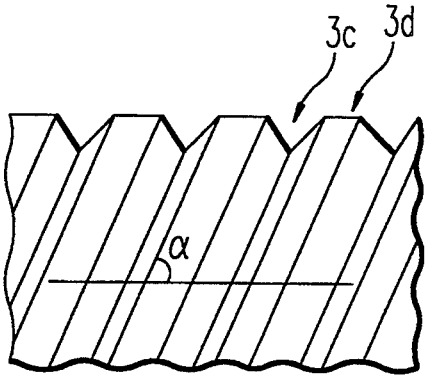

Although the arrangements of FIGS. 1*b* and 3*a* are formed to have rounded grooved surfaces, it may also be possible to provide a V-shaped surface, or in other words, grooved surfaces defined by incline planes which intersect one another at the bottom of the groove as shown in FIGS. 3*b* and 3*c*. Other shapes may also be possible within the scope of the present invention.

As to the inclination angle of the groove 3*c*, as represented by angle α in FIGS. 3*b* and 3*c* with respect to the axial direction of the roller, this angle should be kept relatively small in order to prevent the dot image from causing a "moire" (wavy or rippled appearance). Table 5 shows the results of a comparison of rollers having respective angles α of 89.8 degrees and 70 degrees. The width of the grooves in the axial direction of the rollers was formed as 220 μm, with the neighboring grooves immediately adjacent each other as shown in FIG. 3*b*, with the surface roughness of the rollers 10 μm.

TABLE 5

| | α = 89.8 | α = 70 |
|---|---|---|
| Fogging on the background | ○ | ○ |
| Thinning of the longitudinal line | ○ | ○ |
| "moire" | x | ○~Δ |

Although each of the angles were acceptable from a standpoint of fogging and longitudinal line thinning, the smaller inclination angle e was found to be more acceptable with respect to the "moire" phenomenon. Thus, the inclination angle α should preferably be 70 degrees or less.

As should be readily apparent from the foregoing, in accordance with the present invention, it has been recognized that forming the spiral groove to impart a roughness within the range of 5–30 μm on the surface of the developing roller provides preferable charging characteristics, with the developer carrier or developing roller demonstrating improved performance in the ability to carry toner for developing images. Thus, improved images result, particularly from a standpoint of reducing fogging and reducing the longitudinal line thinning. Further, by utilizing a width of the grooves which is smaller than 400 μm, the performance is maintained, while processing or manufacture of a roller, for example by a lathe, can be readily accomplished particularly for groove widths in the upper level of this range (i.e., smaller than 400 μm). Further improved results are achieved utilizing a one-component developer having an average volume diameter of not larger than 10 μm, with the use of such a toner also found to be beneficial from a fogging and longitudinal line thinning standpoint.

Further, in accordance with the present invention, it has been recognized that a smoothed flat portion may be interposed between the neighboring grooves or neighboring portions of the groove if the width of the flat portions is not excessively large. The allowance for a flat portion interposed between neighboring grooves or groove portions has been found to be advantageous in that the processing time in forming the groove can be shortened, thereby reducing the manufacturing cost of the developing roller as compared with formation of a groove in which neighboring portions are immediately adjacent one another. Moreover, with the groove formed only in the central portion of the roller, the effectiveness of sealing members disposed adjacent to the roller is not diminished.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A developing apparatus for developing a latent image formed on a latent image carrier, the developing apparatus comprising:

a developer carrying roller having a grooved surface thereon such that said grooved surface has a surface roughness of 5 μm–30 μm in an axial direction of said roller, wherein said grooved surface includes a plurality of grooved portions, and wherein flat portions are interposed between neighboring grooved portions in the axial direction of said developer carrying roller, and wherein a width of said flat portions in the axial direction of said developer carrying roller is not greater than 150 μm.

2. A developing apparatus of claim 1, wherein said grooved surface includes a plurality of grooved portions having widths in the axial direction of said developer carrying roller which are not greater than 400 μm.

3. The developing apparatus of claim 1, further including a developer containing compartment which includes developer having an average particle diameter not larger than 10 μm.

4. The developing apparatus of claim 1, wherein widths of said grooves are not larger than 400 μm.

5. The apparatus of claim 1, wherein said grooved surface is formed along a width of said developer carrying roller corresponding only to a latent image forming area of said latent image carrier.

6. A developing apparatus for developing a latent image formed on a latent image carrier, the developing apparatus comprising:

a developer carrying roller having a grooved surface thereon such that said grooved surface has a surface roughness of 5 μm–30 μm in an axial direction of said roller, wherein said grooved surface comprises a spiral groove extending along the axial direction of said roller.

7. The developing apparatus of claim 6, wherein said spiral groove forms a plurality of adjacent grooved portions which are inclined with respect to the axial direction of said developer carrying roller, and wherein an angle of inclination of said grooved portions is not greater than 70 degrees with respect to the axial direction of said developer carrying roller.

8. A developing apparatus for developing a latent image formed on a latent image carrier, the developing apparatus comprising:

a developer carrying roller having a grooved surface thereon such that said grooved surface has a surface roughness of 5 μm–30 μm in an axial direction of said roller, wherein said grooved surface includes a plurality of grooved portions which are inclined with respect to the axial direction of said developer carrying roller, and wherein an angle of inclination of said groove portions is not greater than 70 degrees with respect to the axial direction of said developer carrying roller.

9. A developing method for developing a latent image formed on a latent image carrier comprising:

providing a developer carrying roller having a dielectric layer on an outer surface thereof;

forming a grooved surface in said dielectric layer of said developer carrying roller such that said grooved surface has a roughness in an axial direction of said developer carrying roller of 5 μm–30 μm;

wherein the step of forming a grooved surface includes forming a plurality of grooved portions which are inclined with respect to the axial direction of said developer carrying roller by an angle not greater than 70 degrees.

10. The method of claim 9, wherein the step of providing a grooved surface includes forming a spiral groove in an outer surface of said developer carrying roller.

11. The method of claim 9, wherein the step of forming a grooved surface includes forming a grooved surface with a plurality of grooved portions having widths not larger than 400 μm in the axial direction of said developer carrying roller.

12. The method of claim 9, further including carrying developer with said developer carrying roller with said developer having an average particle diameter not larger than 10 μm.

13. The developing method of claim 9, wherein the step of forming a grooved surface includes forming a grooved surface by machining.

14. The developing method of claim 9, wherein the step of forming a grooved surface includes forming a regular pattern of grooves extending circumferentially about said dielectric layer.

15. A developing method for developing a latent image formed on a latent image carrier comprising:

providing a developer carrying roller having a dielectric layer on an outer surface thereof;

forming a grooved surface in said dielectric layer of said developer carrying roller such that said grooved surface has a roughness in an axial direction of said developer carrying roller of 5 μm–30 μm;

wherein the step of forming a grooved surface includes forming a grooved surface with a plurality of grooved portions having widths not larger than 400 μm in the axial direction of said developer carrying roller; and the method further including providing said plurality of grooved portions with flat portions interposed between neighboring grooved portions, and wherein said flat portions have widths which are not greater than 150 μm in the axial direction of said developer carrying roller.

16. A developing apparatus for developing a latent image formed on a latent image carrier comprising:

a developer carrying roller having an outer layer formed of a dielectric substance; and a grooved surface formed in said outer layer of dielectric substance, said grooved surface having a surface roughness of 5 μm–30 μm in an axial direction of said developer carrying roller;

wherein said grooved surface includes a plurality of grooved portions having widths in the axial direction of said developer carrying roller which are not greater than 400 μm, and wherein said plurality of grooved portions are inclined with respect to the axial direction of said developer carrying roller, and wherein the inclination of said plurality of grooved portions is not greater than 70 degrees with respect to the axial direction of said developer carrying roller.

17. The apparatus of claim 16, wherein said grooved surface comprises a spiral groove.

18. The apparatus of claim 16, wherein said plurality of grooved portions are formed by a spiral groove extending along a substantial portion of said developer carrying roller.

19. The apparatus of claim 16, further including a plurality of flat portions interposed between said plurality of grooved portions, said plurality of flat portions having widths not greater than 150 μm in the axial direction of said developer carrying roller.

20. The developing apparatus of claim 16, wherein said grooves are formed in a regular pattern of grooves extending circumferentially about said dielectric layer.

* * * * *